US010415916B2

(12) United States Patent
Cusano

(10) Patent No.: US 10,415,916 B2
(45) Date of Patent: Sep. 17, 2019

(54) MODIFIED TRIGGER ASSEMBLY AND METHOD FOR ACTUATING A REPEATED SHOT

(71) Applicant: Michael Cusano, Eagle Mountain, UT (US)

(72) Inventor: Michael Cusano, Eagle Mountain, UT (US)

( * ) Notice: Subject to any disclaimer, the term of this patent is extended or adjusted under 35 U.S.C. 154(b) by 0 days.

(21) Appl. No.: 14/560,244

(22) Filed: Dec. 4, 2014

(65) Prior Publication Data

US 2019/0041149 A1 Feb. 7, 2019

(51) Int. Cl.
*F41A 19/30* (2006.01)
*F41A 17/72* (2006.01)
*F41A 19/06* (2006.01)

(52) U.S. Cl.
CPC ..... *F41A 19/30* (2013.01); *F41A 17/72* (2013.01); *F41A 19/06* (2013.01)

(58) Field of Classification Search
CPC ..... F41A 19/10; F41A 19/16
USPC ..... 42/69.01, 41, 132, 136
See application file for complete search history.

(56) References Cited

U.S. PATENT DOCUMENTS 6,354,032 B1 * 3/2002 Viani ..... 42/69.03
9,062,925 B1 * 6/2015 Viani
2005/0034344 A1 * 2/2005 Viani ..... 42/69.01
2006/0236581 A1 * 10/2006 Viani ..... 42/69.01

* cited by examiner

*Primary Examiner* — Samir Abdosh
(74) *Attorney, Agent, or Firm* — Steven Rinehart

(57) ABSTRACT

A modified trigger assembly for a handgun has a shortened trigger bar with an angled end that engages a connector to form a gap that reduces potential energy between the trigger bar and the connector, such that the connector is inhibited from disengaging from the trigger bar when the trigger is pulled or released. A gap forms between an angled end of the trigger bar and a first end of the connector. The gap and the shortened length of the trigger bar reduce potential energy forces that could disengage the connector from the trigger bar. By remaining engaged with the trigger bar, the connector is prevented from resetting to a natural position; and consequently, the handgun can discharge from both a trigger pull position and a trigger release position. Consequently, a repeated shot occurs when releasing the trigger after a natural triggering movement of pulling a trigger.

10 Claims, 5 Drawing Sheets

MODIFIED TRIGGER ASSEMBLY AND METHOD FOR ACTUATING A REPEATED SHOT

FIELD OF THE INVENTION

This invention relates to a modified trigger assembly that actuates faster follow up shot when a trigger is pulled and released, and more particularly relates to a modified trigger assembly for a handgun that has a shortened trigger bar with an angled end that engages a connector to form a gap that reduces potential energy between the trigger bar and the connector.

BACKGROUND

Description of the Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

A handgun is a firearm designed to be handheld, in either one or both hands. Major handgun subtypes are the revolver and pistol; other subtypes include derringers, single-shot pistols, semi-automatic pistols, pepperboxes, and machine pistols. Typically, a semi-automatic handgun discharges repetitively by using the energy of one shot to reload the chamber for the next. Typically recoil energy from a fired round is mechanically harnessed; however, pistols chambered for more powerful cartridges may be gas operated. After a round is fired, the pistol will cycle, ejecting the spent casing and chambering a new round from the magazine, allowing another shot to take place.

It is well known that a Glock® handgun utilizes a safe action mechanism that is neither a single nor double action. The Glock® is never cocked in terms of a hammer being cocked. The partly tensioned firing pin lock is released by pressing the trigger. Typically, the Glock® incorporates a design with three levels of integrated safety, known as safe action. First, an integrated trigger latch prevents the trigger body from moving unless the trigger is depressed (e.g. positively squeezed). Second, the handgun's striker-firing mechanism is locked in place by a trigger bar linked to the trigger; the striker cannot move unless the trigger is depressed. Third, as with most handguns, a firing pin block actuated by the same trigger bar prevents the pin coming into contact with the primer unless the trigger is pulled to clear the block.

In the known art, one end of the trigger bar that engages a connector at a predetermined surface and angle off vertical. This flat surface generates a strong potential energy when pressed against the connector, which causes the connector to disengage from the trigger bar at a certain point of engagement, such as when the trigger is depressed. The disengagement of the connector results in the inability of the trigger to release the sear where further discharge is not possible until the connector resets and the trigger is depressed again. Consequently, the connector prevents the handgun from firing until the handgun has not only been fully and completely cycled, but the trigger is released and depressed again, allowing the connector to reset with the trigger bar.

In view of the foregoing, it is clear that these traditional trigger assemblies are not perfect and leave room for more optimal approaches to a modified trigger assembly for a handgun that has a shortened trigger bar with an angled end that slidably engages a connector at a reduced potential energy, such that the connector maintains contact with the trigger bar to operatively release a striker for discharging one round from the handgun when the trigger is pulled or released.

SUMMARY

From the foregoing discussion, it should be apparent that a need exists for a modified trigger assembly for a handgun for actuating a faster follow up shot. The present invention has been developed in response to the present state of the art; and, in particular, in response to the problems and needs in the art that have not yet been fully solved by currently available methods and apparati, and that overcomes many or all of the above-discussed shortcomings in the art. Accordingly, the present invention has been developed to provide a modified trigger assembly for actuating a faster follow up shot.

A modified trigger assembly for actuating a repeated shot with a firearm is provided, the assembly comprising: a connector modified to reset faster, the connector comprising: a first end and a second end, the first end comprising a connector hook and a shelf 107, wherein a height of the shelf 107 is reduced, wherein the shelf 107 is angled to more quickly position the trigger bar for reengagement with the connector; a trigger bar configured to slide into engagement with the first end of the connector, the trigger bar comprising: an angled end and a trigger end, wherein a thickness of the angled end is reduced; wherein a curvature of the angled end which engages the connector is reduced; wherein the modified trigger assembly is configured to actuate a repeated shot of the firearm when a trigger is released.

The assembly may further comprise a cruciform comprising: angled a portion of the cruciform which engages a firing pin, and bending upward the portion of the cruciform which engages the firing pin.

The trigger bar may be configured to reciprocate axially between the trigger pull position and the trigger release position. The assembly may further comprise a trigger spring configured to generate a spring tension for biasing the trigger bar rearward. The angled end may comprise an angle of between 0 and 90 degrees.

The connector hook may be configured to press inward on the connector for disengaging the connector from the trigger bar changing the release time. The releasing of the striker may free a firing pin to drive forward into a primer for discharge of the handgun.

A method for modifying trigger assembly to actuate repeated shots is provided, the method comprising: modifying a trigger bar by changing an angle of an angled end of the trigger bar to engage a connector to reduce a force required to drop a cruciform out of contact with a firing pin lobe; reducing a thickness of the angled end of the trigger bar; engaging a first end of the connector with the angled end of the trigger bar; actuating a first discharge of a handgun with a rearward depression of the trigger to complete interaction of the trigger bar with the connector such that the cruciform disengages a firing pin lobe such that a striker strikes a primer of a bullet.

The method may further comprise modifying a shelf 107 of the connector by reducing a width of a cantilevered portion of the shelf 107. The method may further comprise modifying a shelf 107 of the connector by reducing a height of a cantilevered portion of the shelf 107.

The method may further comprise bending upward a portion of the cruciform which engages the firing pin lobe.

The method, in some embodiments, further comprises angling the portion of the cruciform which engages the firing pin lobe to facilitate more rapid disengagement of the cruciform and the firing pin lobe. The modified trigger assembly may be configured to actuate a faster follow up shot of the handgun. The angled end may comprise an angle of about 40 degrees above horizontal.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which:

FIG. 1A shows a trigger pull position from a right side, and FIG. 1B shows a trigger release position from a right side, and FIG. 1C shows the modified trigger assembly from a left side, in accordance with the present invention;

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. One skilled in the relevant art will recognize that the invention may be practiced without one or more of the specific details, or with other methods, components, materials, and so forth. In other instances, well-known structures, materials, or operations are not shown or described in detail to avoid obscuring aspects of the invention.

It is the object of the present invention to provide a weapon which comports with present governmental requirements that a firearm discharge only one round with "a single function of the trigger." 26 U.S.C. § 5845(b). The present invention provides for a firearm which discharges one round when the trigger is depressed with movement of the finger, and another round when the trigger is released with a subsequent movement of the finger.

Figure 1A:
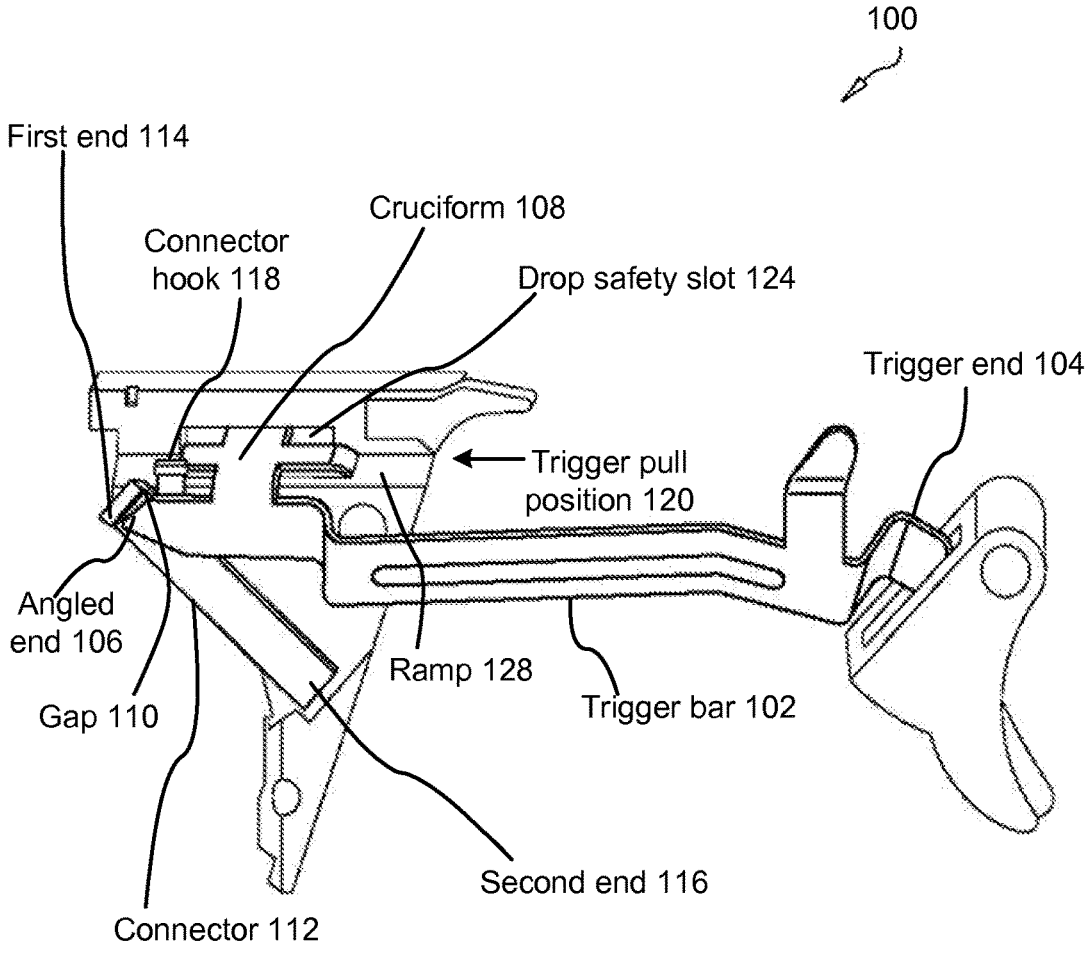
FIGS. 1A, 1B, and 1C are perspective side views illustrating an exemplary modified trigger assembly, where
Figure 1B:
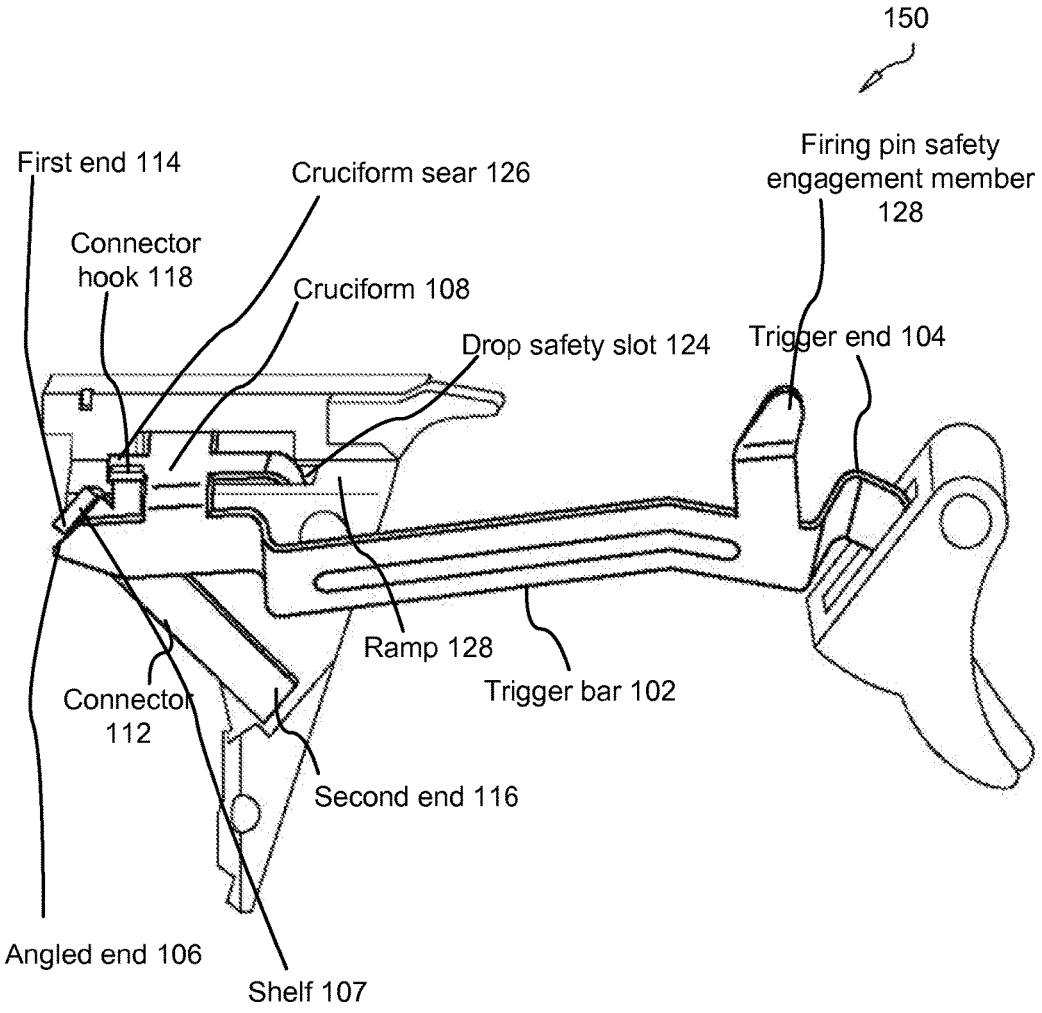
Figure 1C:
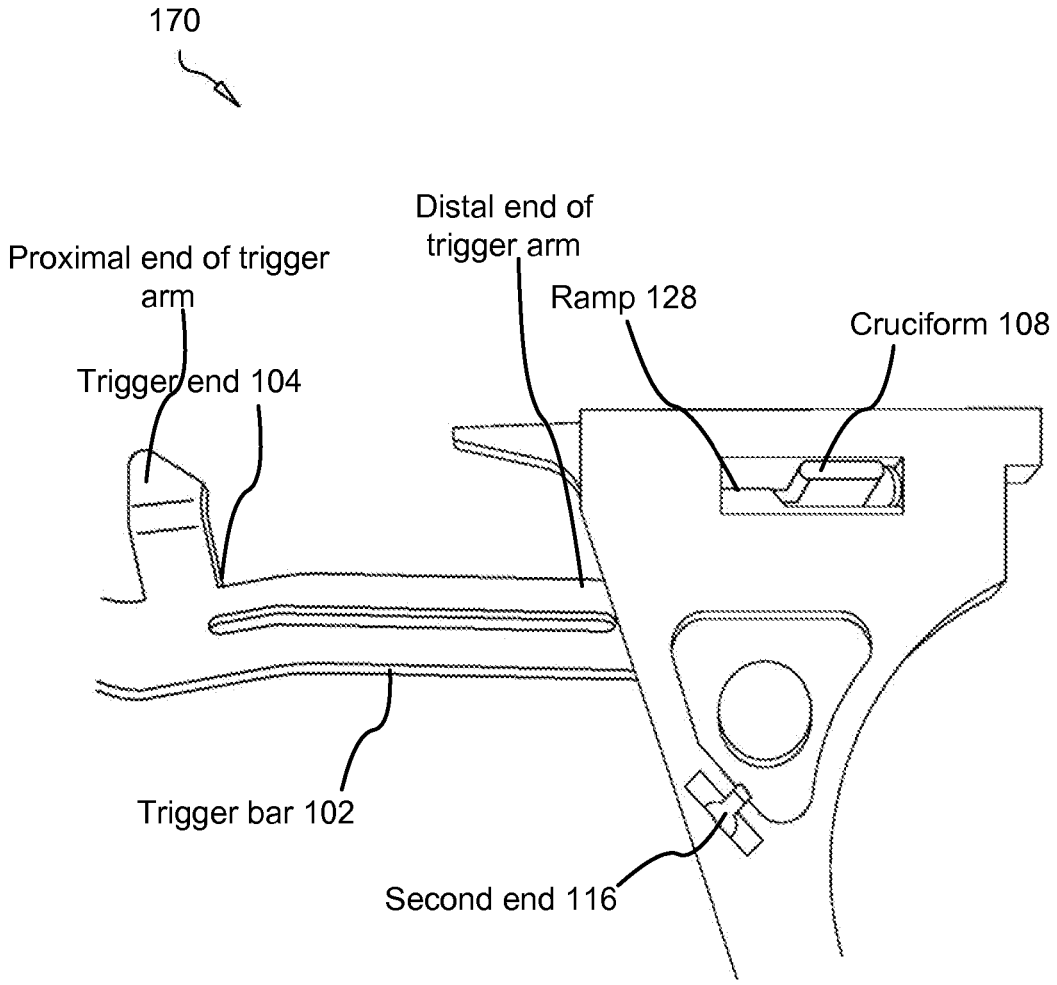

FIGS. 1A and 1B show a right upper perspective views of a modified trigger assembly. FIG. 1C show a left lower perspective view of an exemplary modified trigger assembly 100 with components. The modified trigger assembly 100 comprises a trigger bar 102 having an angled end 106, a trigger end 104, a cruciform 108, a connector 112 having a first end 114 and a second end 116 and a connector hook 118.

Semiautomatic pistols comprise a slide which travels rearward when a shot is actuated or discharged. This slide comprises a slide cam hump, which pushed the connector hook 118 inward as the slide travels.

The modified trigger assembly 100 comprises a trigger bar 102 (also called a "trigger arm") with an angled end 106 (also called a "first end") that engages a connector 112. A gap 110 forms between the angled end 106 of the trigger bar 102 and a first end 114 of the connector 112.

The cruciform 108 is affixed to the trigger bar 102. When the trigger is pulled (or depressed rearward), the trigger bar 102 engages the connector 112 and the cruciform 108 slides the striker/firing pin rearward before dropping away and allowing the firing pin to strike and detonate the primer of a bullet, resulting in firing of the weapon.

The trigger bar 102 further comprises an angled end 106 that is responsive to the action on the trigger end 104. The angled end 106 is beveled at a predetermined slope and polished to slidably engage a first end 114 of a connector 112. The angled end 106 slides down the first end 114, which forms a gap (i.e. clearance) 110. The clearance 110 forms between the angled end 106 and the first end 114 due to the angle formed at the angled end 106, and the shortened length of the trigger bar 102. In one embodiment, the angled end 106 may have an angle of about 40°. In other embodiments, the angled end 106 form an angle of 0 to 90 degrees off horizontal. The trigger bar 102 may have a length of about 2.286 inches until the angled end. In other embodiments, the length may vary from 0.1 inches to six inches or more off horizontal. However in other embodiments, other angles and lengths that form a sufficient gap 110 may be used.

The angled end 106 slidably engages the first end 114 at a downward angle, laterally and downwardly displacing the trigger bar and cruciform. This lateral displacement of the connector 112.

The drop safety slot 124 is configured to prevent the cruciform 108 from dropping out of engagement with the firing pin lobe unless the trigger has been depressed sufficiently rearward. The cruciform 108 slopes up along a ramp to conform to the shape of the drop safety slot 124, securing the connection of the cruciform and the firing pin lobe.

In some embodiments, the ramp 128 can be modified to extend further so that the cruciform 108 can slide in and out of the drop safety slot 124 more efficiently. However in other embodiments, the cruciform 108 could be extended to better engage the drop safety slot 124. It is significant to note that the cruciform 108 can be wider than the ramp 128 in some embodiments. This wider formation enables the cruciform 108 to remain engaged with the ramp 128 for a longer duration before falling into the drop safety slot 124.

In some embodiments, the connector 112 comprises a generally flat bar that orients at an angle relative to the trigger bar 102. The connector 112 comprises a first end 114 and a second end 116. The first end 114 comprises a cantilevered flange or shelf 107 that extends perpendicularly from the connector 112. It is the shelf 107 that directly engages the angled end 106 at a predetermined angle. In various embodiments, the outer surface of the shelf 107 may be angled inward. The angled end 106 of the trigger bar 102 may be angled inward. These angled ends of the trigger bar 102 and the shelf 107 change the degree of friction between the trigger bar 102 and the shelf 107 necessary to force the trigger bar 102 downward when the trigger is depressed.

The first end 114 engages the angled end 106 from both the trigger pull position 120 and the trigger release position 122. Due partially to the determined length of the trigger bar 102 (and/or reformed angles of the angled end of the trigger bar 102); the connector 112 is from disengaging from the angled end 106 of the trigger bar 102. A faster follow up shot of a handgun is possible through one natural discharge movement by pulling the trigger bar 102; and, at the operator's discretion, releasing the trigger bar 102 allowing a follow up shot.

The follow up shot is allowed when a reset of the connector and trigger bar is effectuated due to the redesign of the connector 112 and the trigger bar's 102 interaction along with the assistance of the trigger spring, thus discharging the next round sitting in the chamber.

The trigger assembly 100 comprises modified trigger assembly components modified in such a way that the firearm fires a round both when the trigger is depressed and when the trigger is released.

The portion of the cruciform 108 which engages the striker or firing pin, in some embodiments, is modified by being bent upward and the thickness of this engaging portion of the cruciform 108 is increased or decreased. In some embodiments, the thickness is reduced by grinding, inclining or angling the upper or topmost surface of the engaging portion of the cruciform upward. In some embodiments, the cruciform is manufactured with these modifications. In other embodiments, a cruciform of the prior art is modified.

The cruciform sear 126 engages the firing pin. The cruciform sear 126 comprises the rearward tab of the cruciform 108 which directly engages the firing pin above the cruciform 108.

The thickness of the angled end 106 of the trigger bar 102 may be reduced, narrowed, ground down, sharpened or angled inward. In the prior art, the angled end of the trigger bar 102 is rounded. The portion of the triggered bar 102 which engages the first end 114 of the connector 112 has a curvatured engaging surface. The angled end 106 of the modified trigger bar 102 comprises an engaging surface in which the curvature is reduced or eliminated. The engaging surface may be more linear or flat, causing the angled end 106 of the trigger bar 102 to drop downward more quickly, thus releasing the cruciform 108 from engagement with the striker or firing pin.

The first end 114 comprises a cantilevered shelf 107 protruding outwardly from the connector 112, the shelf 107 has an outer surface and an engaging surface which engages the angled end 106 of the trigger bar 102. The first end 114 of the connector 112 comprises the shelf In some embodiments, the thickness of the shelf 107 is reduced, narrowed, ground down or otherwise reangled or reshaped. The outwardly protruding width of the shelf 107 may be reduced. The shelf 107 may be manufactured in this manner or modified in this manner. The shelf 107 may be reshaped such that the lower, cantilevered surface of the shelf 107 is inclined or declined at a greater or lesser degree off horizontal from the stock configuration of the shelf 107.

When the cruciform 108 drops, and the first bullet is fired, the slide of the gun is forced rearward by the recoil and the firing pin lobe comes to rest again on the cruciform 108. With the modified components of the trigger assembly 100 forming the modified trigger assembly 100, the firearm discharges a second, or repeated, shot upon release of the trigger, unless the operator chooses not to discharge the second shot.

The present invention enables faster follow up shots of a handgun through a natural triggering movement of pulling a trigger and, at the operator's discretion, releasing the trigger to release the follow up shot.

The connector hook 118 (also called the "upper lobe 118" or "extension" or "connector palm") is a cantilevered lip protruding outwardly from the connector, which engages the slide cam of the handgun (or "slide cam hump"). The point at which the connector hook 118 engages a slide cam hump is the connection junction.

As referenced in FIGS. 1A and 1B, the trigger assembly 100 is configured to operate with a handgun. The handgun may include, without limitation, a Glock® handgun, a semi-automatic handgun, and a pistol. However, in one alternative embodiment, the trigger assembly 100 may be modified for a semi-automatic rifle that discharges through the use of a trigger bar 102.

The trigger bar 102 may include a planar bar that is sized and dimensioned to reciprocate axially between a trigger pull position 120 (wherein the trigger bar 102 is displaced towards a grip on the handgun); and a trigger release position 122 (wherein the trigger bar 102 is displaced towards a barrel of the handgun).

Turning now to FIG. 1C, which is a left side view of the trigger assembly 100, the trigger bar 102 comprises a trigger end 104 that forms a surface for enabling the pulling and releasing of the trigger assembly 100. The trigger end 104 may include a curved member that is sized and dimensioned to receive a finger. The trigger bar 102 reciprocates axially in response to a predetermined force applied on the trigger end 104. In one embodiment, the finger applies pressure to the trigger end 104 to move the trigger bar 102 to the trigger pull position 120; and releases the trigger end 104 to enable the trigger bar 102 to move to the trigger release position 122.

Figure 2:
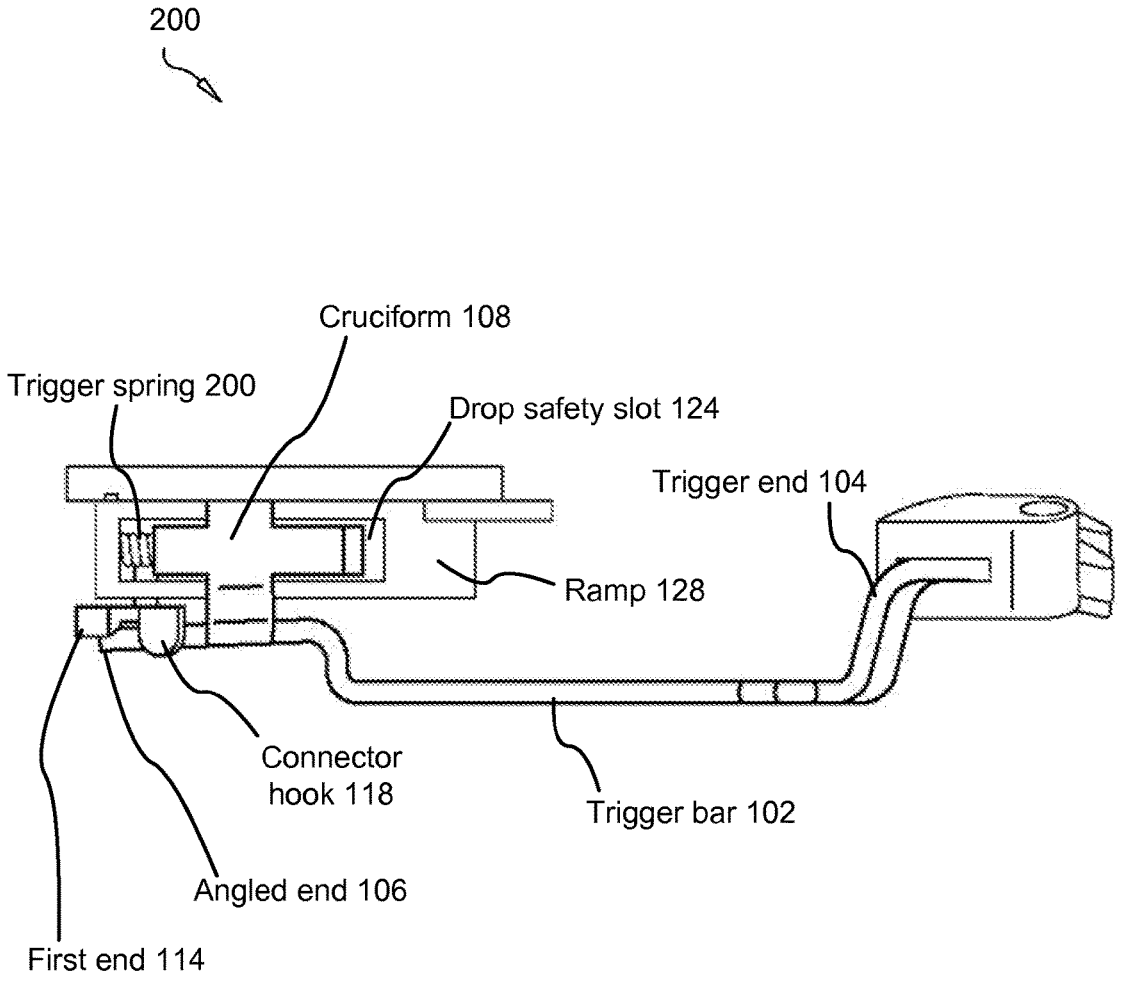
FIG. 2 is a top perspective view of the modified trigger assembly, in accordance with the present invention.

As shown in FIG. 2, a trigger spring 200 is configured to generate a spring tension for biasing the trigger bar 102 rearward such that the trigger bar's 102 reshaped angled end engages the connector 112's reshaped shelf 107 in such a fashion so as to. The connector 112 moves laterally against a spring tension, which biases the connector 112 inwardly against the handgun. The spring tension is what enables the connector 112 to disengage from the trigger bar 102, and thus reset to the default position.

The connector 112 is displaced from either of two extreme positions of the trigger bar 102. In one embodiment, a trigger pull position 120 is created by applying a predetermined force on the trigger end 104. The force is sufficient to press the angled end 106 of the trigger bar 102 down and against the shelf 107 of the first end 114, thereby displacing the connector 112 outwardly from the handgun, against the spring tension. This outward displacement forces the cruciform 108 to release the striker, which subsequently releases a cocked firing pin to drive forward and strike a primer. Those skilled in the art, in light of the present teachings, will recognize that the angled end 106 is substantially flat and not angled. This flat surface enables the connector 112 to disengage from the trigger bar 102, returning to the default positon where a second discharge is not possible.

It is also significant to note that in the present invention, the shortened length of the trigger bar 102 and the beveled surface slope on the angled end 106 cause the connector 112 to be displaced when the trigger bar 102 resets to a trigger release position 122.

The shortened length of the trigger bar 102 does not extend sufficiently to engage the connector 112, and thus the connector 112 is inhibited from generating sufficient potential energy to forcefully disengage from the trigger bar 102. Rather than fully resetting at the trigger release position 122, the force of the trigger bar 102, at the specific angle and length, displaces the connector 112 to release the striker for a second time. This double displacement of the connector 112 is what enables the handgun to be discharged upon pulling and releasing of the trigger end 104.

In operation, the angled end 106 which is designed to a predetermined shape, angle and form remains in contact with the connector 112 throughout all phases of the operation. When the trigger is depressed rearward, the trigger bar 102's angled end 106 which is beveled to a predetermined angle, remains engaged with the first end 114 of the connector 112 throughout all phases of the discharge. When the trigger bar 102 moves to the trigger pull position 120, the angled end 106 creates sufficient force against a shelf 107 on the first end 114 to force an inward lateral displacement of the connector 112.

After the first discharge, when the trigger bar 102 moves from the trigger pull position 120 to the trigger release position 122, the connector 112 does not disengage from the angled end 106 to reset to the default position after discharge. The trigger bar 102 rides the shelf 107 at a downward angle. This downward sliding movement serves to laterally displace the connector 112 inwardly. This inward lateral displacement of the connector 112 releases the striker for the second discharge of the handgun. In this manner, the connector 112 is displaced to operatively release the striker from either of two extreme positions of the trigger bar 102.

Faster lock times produce enhanced accuracy because it diminishes the time for barrel movement.

In exigent combat situation, shooters tend to pull, depress or grip the trigger is overly aggressive fashion, without fine motor skills or dexterity, throwing the firearm off target. In accordance with the present invention, the firearm stays on target for follow up shots because the release of the trigger requires less muscle movement than depression.

Figure 3:
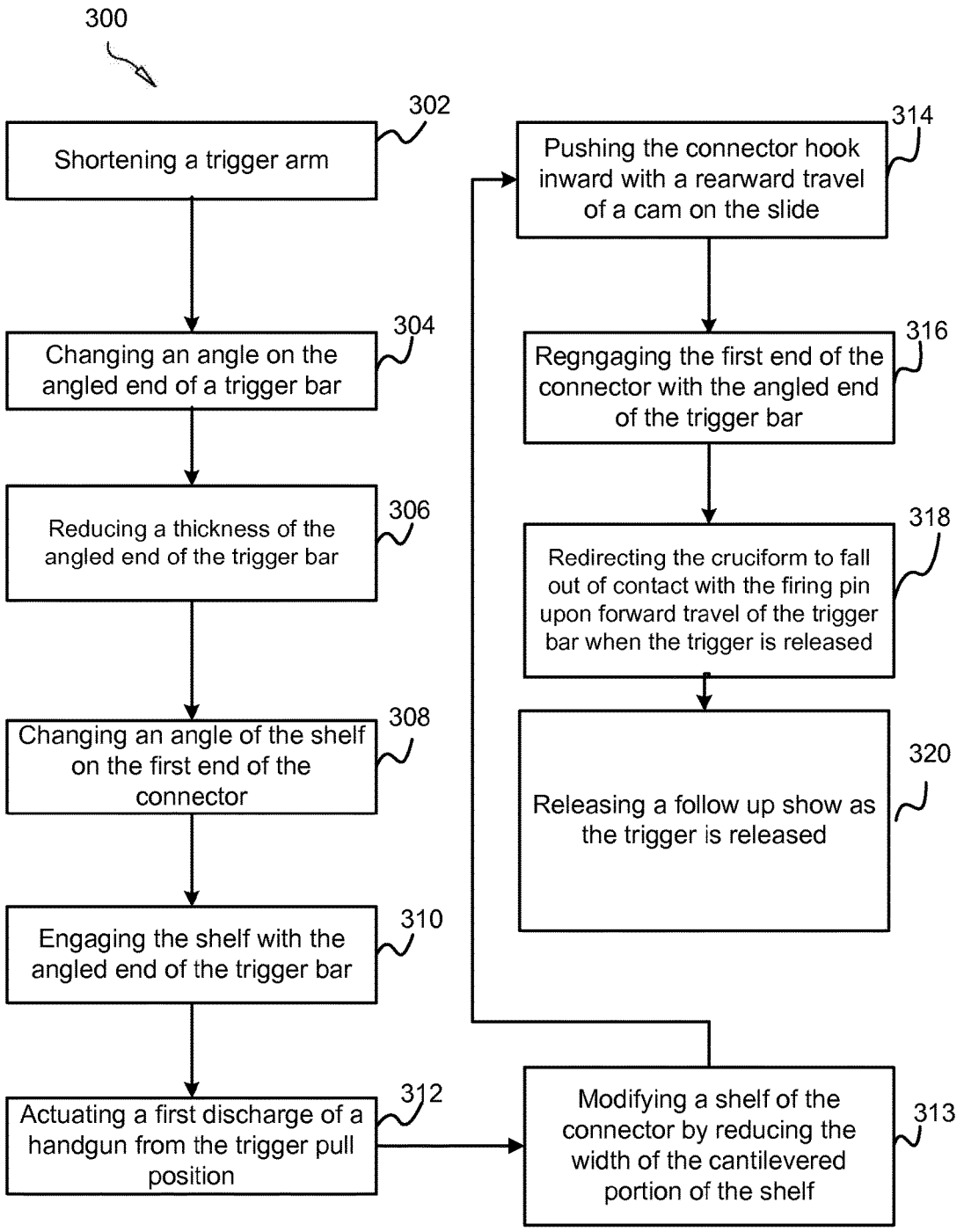
FIG. 3 is a flowchart diagram of an exemplary method for discharging a modified trigger assembly, in accordance with the present invention.

FIG. 3 shows a flowchart diagram of an exemplary method 300 for modifying a trigger assembly 100 to actuate a repeated shot of a firearm. The method 300 includes a Step 302 of shortening a trigger bar 102 with an angled end 106 that engages a connector 112. In some embodiments, the method 300 may further comprise a Step 304 of changing an angle on the angled end of the trigger bar 102. The angle may be flattened, beveled, ground down, sharpened, reduced or otherwise modified in Step 306. The angled end 106 may be flattened at a predetermined slope and polished to slidably engage a first end 114 of a connector 112. In some embodiments, the angled end 106 is narrowed, bent inward or outward, or ground down.

A Step 308 includes changing an angle of the shelf 107 on the first end of the connector 112. The angle at which the shelf 107 engages the angled 106 of the trigger bar 102 is changed to reduce or extend the time of engagement between the trigger bar 102 and the shelf 107.

In one embodiment, the finger applies pressure to the trigger end 104 when the trigger bar 102 is in the trigger pull position 120; and releases the trigger end 104 when the trigger bar 102 is in the trigger release position 122.

In some embodiments, a Step 310 comprises engaging the first end 114 of the connector 112 with the angled end 106 of the trigger bar 102. The engaging surface of the angled end 106 slides across a lower surface of the shelf 107.

A Step 312 may include dropping the cruciform 108 to release the striker when the trigger is depressed. When the trigger bar 102 travels rearward to the trigger pull position 120, the angled end 106 creates sufficient force against the shelf 107 on the first end 114 to force the trigger bar 102 downward out of contact with the shelf 107. The cruciform 108 moves downward with the trigger bar 102 which in turn, releases the striker, actuating a shot.

In some embodiments, the Step 312 may include actuating a first discharge of a handgun from the trigger pull position 120. Release of the striker as described above subsequently releases a cocked firing pin to drive forward and strike a primer for the first discharge of the handgun.

The method 300 may further comprise a Step 313 of modifying the shelf 107 by reducing a width, height or thickness of the cantilevered portion of the shelf 107. This reduction may take place using any means known to those of skill in the art, including grinding the shelf 107 down, bending the shelf, and the like.

In a Step 314, the connector hook 118 in some firearms is pushed inward by a rearward travel of a slide having a cam hump. In some variations of handguns, the slide (not shown) interacts with the connector 112 in some fashion as known to those of skill in the art.

Continue Revisions Here

A Step 316 includes engaging the first end 114 of the connector 112 with the angled end 106 of the trigger bar 102. A Step 318 comprises forming a gap 110 between the angled end 106 and a first end 114 of a connector 112. The gap 110 formed between the angled end 106 and the flange on the connector 112 may create sufficient spacing, such that the angled end 106 can maintain contact with the shelf at a downward angle.

In some embodiments, a Step 320 may include maintaining contact between the first end 114 and the angled end 106. A Step 322 comprises displacing the connector 112 from the cruciform 108 to release the striker. After the first discharge, when the trigger bar 102 moves from the trigger pull position 120 to the trigger release position 122, the connector 112 does not disengage from the angled end 106 to reset to the default position after discharge. Rather, the gap 110 formed between the angled end 106 and the flange on the connector 112 creates sufficient spacing, such that the angled end 106 can maintain contact with and ride the flange at a downward angle. This downward sliding movement serves to laterally displace the connector 112 inwardly towards the handgun, and against a spring tension created by a trigger spring 200. This inward lateral displacement of the connector 112 forces the connector hook 118 member down onto the cruciform 108, which in turn, releases the striker for the second discharge of the handgun. A final Step 324 includes actuating a second discharge of the handgun from the trigger release position 122.

In operation, the firearm performs a first discharge and a follow up shot. The trigger end 104 is initially pulled. This action causes the trigger bar 102, which is connected to the angled end 106, to slide down the first end 114. The cruciform 108 consequently slides along the ramp 128 to release the striker and perform a first discharge. The trigger end 104 is still held rearward, so that the cruciform 108 and the angled end 106 remain dropped into the drop safety slot 124. The trigger bar 102 moves back to a highpoint, which causes the trigger bar 102 to engage the connector 112, pushing the connector 112 towards the firearm. This allows the first end 114 to move towards the firearm, which breaks the connection between the angled end 106 and the first end 114. Since the angled end 106 and the first end 114 are not sliding against each other at this point, the first end 114 and the cruciform 108 are pushed inwardly, towards the firearm. This causes the angled end 106 to pop up and ride a face of the first end 114. The connector 112 is disconnected from the trigger bar 102 at this point, and a first discharge is complete.

The firearm may then reset for a repeat shot. The angled end 106 pops up and over the first end 114 resting on the ramp 128. Because of the gap 110, the angled end 106 rides up on the first end 114 of the connector 112. The angled end 106 remains there with the trigger bar 102 pulled rearward. The angled end 106 slides on the first end 114 and drops away. Consequently, the angled end 106 restricts the first end 114 from moving outwardly from the firearm. It is significant to note that the first end 114 may be spring steel, which has sufficient resiliency for this action. Once the first end 114 slides rearward, the cruciform 108 drops down into the drop safety slot 124 and disengages from the striker to actuate the follow up shot.

The present invention has been developed in response to the present state of the art, and in particular, in response to the problems and needs in the art that have not yet been fully solved by currently available apparatus. In one embodiment of the present invention, the modified trigger assembly 100 discharges the handgun when the trigger end 104 of the trigger bar 102 is pulled and released.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for modifying a trigger assembly to actuate a faster follow up shot, the method comprising:

modifying a trigger bar by changing an angle of an angled end of the trigger bar to engage a shelf of a connector to reduce a force required to drop a cruciform out of contact with a firing pin lobe;

reducing a thickness of the angled end of the trigger bar;

changing an angle of the shelf on the first end of the connector;

engaging the shelf on the first end of the connector with the angled end of the trigger bar;

actuating a first discharge of the firearm with a rearward depression of the trigger to complete interaction of the trigger bar with the connector such that the cruciform disengages a firing pin lobe such that a striker strikes a primer of a bullet; and actuating a second discharge of the handgun when the trigger is released.

2. The method of 1, wherein the second discharge is actuated after the connector hook is pushed inward by a rearward travel of a slide cam hump, such that the angled end of the connector reengages the trigger bar at a different angle such that subsequent forward travel of the trigger bar upon trigger release redirects the cruciform to fall out of contact with the firing pin, actuating a follow up shot.

3. The method of claim 1, further comprising modifying the shelf of the connector by reducing a width of a cantilevered portion of the shelf.

4. The method of claim 1, further comprising modifying the shelf of the connector by reducing a height of a cantilevered portion of the shelf.

5. The method of claim 1, further comprising angling upward an edge of a cruciform sear which engages the firing pin lobe.

6. The method of claim 1, further comprising angling downward an edge of a cruciform sear which engages the firing pin lobe.

7. The method of claim 1, further comprising altering an angle of an edge of a cruciform sear which engages the firing pin lobe.

8. The method of claim 1, further comprising angling the cruciform sear which engages the firing pin lobe to guide the cruciform downward facilitating accelerated disengagement of the cruciform from the firing pin lobe.

9. The method of claim 4, further comprising angling a portion of the cruciform which engages a sloped surface defining a drop safety slot to the increase a surface area of contact between the portion of the cruciform and the sloped surface.

10. The method of claim 1, wherein the modified trigger assembly is configured to reduce the time between shots of the firearm by actuating a follow up shot of the firearm on trigger release.

* * * * *